US010353310B2

(12) United States Patent
Fujita et al.

(10) Patent No.: US 10,353,310 B2
(45) Date of Patent: Jul. 16, 2019

(54) ELECTROSTATIC-IMAGE DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Asafumi Fujita, Kanagawa (JP); Shinichi Yaoi, Kanagawa (JP); Yasushige Nakamura, Kanagawa (JP); Seijiro Ishimaru, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 29 days.

(21) Appl. No.: 15/695,604

(22) Filed: Sep. 5, 2017

(65) Prior Publication Data

US 2018/0143551 A1 May 24, 2018

(30) Foreign Application Priority Data

Nov. 24, 2016 (JP) ..... 2016-228275

(51) Int. Cl.
*G03G 9/087* (2006.01)
*G03G 9/08* (2006.01)
(Continued)

(52) U.S. Cl.
CPC ..... *G03G 9/08755* (2013.01); *G03G 9/0819* (2013.01); *G03G 9/0827* (2013.01);
(Continued)

(58) Field of Classification Search
CPC ..... G03G 9/08755
See application file for complete search history.

(56) References Cited

U.S. PATENT DOCUMENTS

2006/0194136 A1* 8/2006 Daimon ..... G03G 9/08755 430/108.21
2010/0248123 A1* 9/2010 Iwanaga ..... G03G 9/0819 430/109.4
(Continued)

FOREIGN PATENT DOCUMENTS

JP 2005-037748 A 2/2005
JP 2005-157074 A 6/2005
(Continued)

OTHER PUBLICATIONS

Translation of JP 2014-081592.*

*Primary Examiner* — Peter L Vajda
(74) *Attorney, Agent, or Firm* — Oliff PLC

(57) ABSTRACT

An electrostatic-image developing toner contains toner particles, each including a core particle and a shell layer disposed on at least a portion of a surface of the core particle. The core particle contains a first amorphous polyester resin containing structural units derived from a polycarboxylic acid and structural units derived from a polyol. About 5% by mass or less of the structural units derived from the polyol are structural units derived from a polyol containing a bisphenol-A backbone. The shell layer contains a second amorphous polyester resin containing structural units derived from a polycarboxylic acid and structural units derived from a polyol. About 50% by mass or more of the structural units derived from the polyol are structural units derived from a polyol containing a bisphenol-A backbone. The electrostatic-image developing toner has a water content of about 2.0% to about 5.0% by mass.

18 Claims, 2 Drawing Sheets

(51) Int. Cl.
*G03G 9/093* (2006.01)
*G03G 15/08* (2006.01)

(52) U.S. Cl.
CPC ..... *G03G 9/09328* (2013.01); *G03G 9/09371* (2013.01); *G03G 15/0865* (2013.01)

(56) References Cited

U.S. PATENT DOCUMENTS

| | | | | |
|---|---|---|---|---|
| 2012/0082926 | A1* | 4/2012 | Suzuki | G03G 9/0804 430/105 |
| 2014/0113229 | A1* | 4/2014 | Tani | G03G 9/0806 430/108.21 |

FOREIGN PATENT DOCUMENTS

| | | | | |
|---|---|---|---|---|
| JP | 2010-139937 | A | 6/2010 | |
| JP | 2014-081592 | * | 5/2014 | G03G 9/087 |
| WO | 2005/038531 | A1 | 4/2005 | |
| WO | 2008/090919 | A1 | 7/2008 | |

* cited by examiner

ELECTROSTATIC-IMAGE DEVELOPING TONER, ELECTROSTATIC IMAGE DEVELOPER, AND TONER CARTRIDGE

CROSS-REFERENCE TO RELATED APPLICATIONS

This application is based on and claims priority under 35 U.S.C. 119 from Japanese Patent Application No. 2016-228275 filed Nov. 24, 2016.

BACKGROUND (i) Technical Field

The present invention relates to electrostatic-image developing toners, electrostatic image developers, and toner cartridges.

(ii) Related Art

Recently, electrophotographic processes have been used in a wide range of applications, from copiers to office network printers, PC printers, and on-demand printers, with the development of equipment and the expansion of communication networks in the information society. Accordingly, there is a growing need for high image quality, high speed, high reliability, small size and weight, and high energy efficiency both in monochrome and color electrophotographic processes.

A typical electrophotographic process involves forming a fixed image through multiple steps, including electrically forming an electrostatic image on a photoreceptor (image carrier) that uses a photoconductive material by various techniques, developing the electrostatic image with a developer containing a toner, transferring the toner image from the photoreceptor to a recording medium such as paper, either directly or via an intermediate transfer member, and fixing the transferred image to the recording medium.

To provide a toner having both low-temperature fixability and offset resistance, polyester resins, which are effective for achieving low-temperature fixability, are useful as binder resins. However, in a situation where an image-forming apparatus starts image formation immediately after power-on from a power-off state in a low-temperature, low-humidity environment, e.g., in winter, it is possible that the fixing member of the fixing device has yet to reach a predetermined temperature range. This may make it difficult to supply a sufficient amount of heat to fix a toner image to a recording medium. Thus, the fixing member tends to have an insufficient amount of heat to melt a toner image, and the use of a toner containing a polyester resin as a binder resin may result in cold offset.

SUMMARY

According to an aspect of the invention, there is provided an electrostatic-image developing toner containing toner particles, each including a core particle and a shell layer disposed on at least a portion of a surface of the core particle. The core particle contains a first amorphous polyester resin containing structural units derived from a polycarboxylic acid and structural units derived from a polyol. About 5% by mass or less of the structural units derived from the polyol are structural units derived from a polyol containing a bisphenol-A backbone. The shell layer contains a second amorphous polyester resin containing structural units derived from a polycarboxylic acid and structural units derived from a polyol. About 50% by mass or more of the structural units derived from the polyol are structural units derived from a polyol containing a bisphenol-A backbone. The electrostatic-image developing toner has a water content of about 2.0% to about 5.0% by mass.

BRIEF DESCRIPTION OF THE DRAWINGS

An exemplary embodiment of the present invention will be described in detail based on the following figures, wherein.

DETAILED DESCRIPTION

Figure 1:
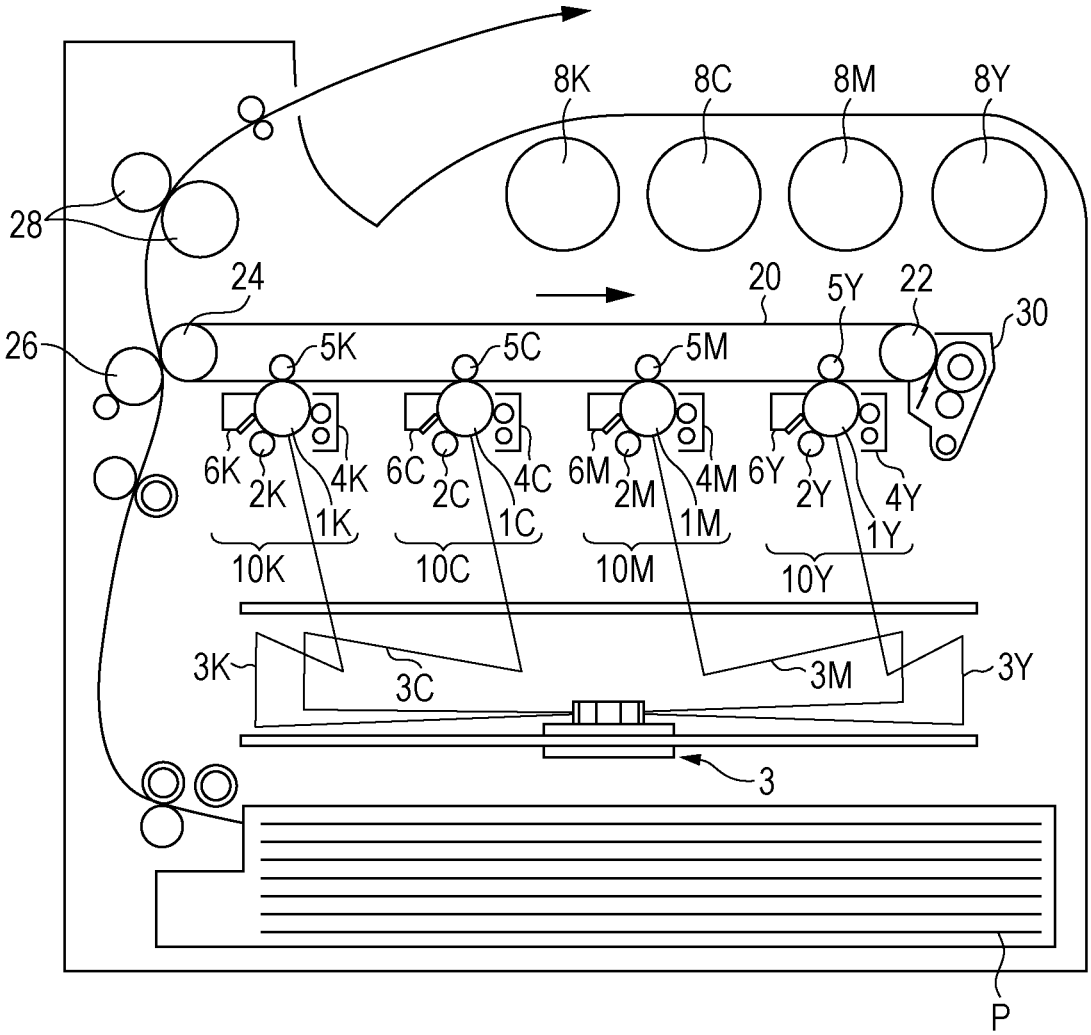
FIG. 1 is a schematic view of an example image-forming apparatus according to this exemplary embodiment.

An electrostatic-image developing toner, an electrostatic image developer, a toner cartridge, a process cartridge, an image-forming apparatus, and an image-forming method according to an exemplary embodiment of the present invention will now be described in detail.

Electrostatic-Image Developing Toner

An electrostatic-image developing toner (which may hereinafter be simply referred to as "toner") according to this exemplary embodiment contains toner particles, each including a core particle and a shell layer disposed on at least a portion of a surface of the core particle. The core particle contains a first amorphous polyester resin containing structural units derived from a polycarboxylic acid and structural units derived from a polyol, and 5% by mass or less or about 5% by mass or less of the structural units derived from the polyol are structural units derived from a polyol containing a bisphenol-A backbone. The shell layer contains a second amorphous polyester resin containing structural units derived from a polycarboxylic acid and structural units derived from a polyol, and 50% by mass or more or about 50% by mass or more of the structural units derived from the polyol are structural units derived from a polyol containing a bisphenol-A backbone. The electrostatic-image developing toner has a water content of 2.0% to 5.0% by mass or about 2.0% to about 5.0% by mass.

The use of the toner according to this exemplary embodiment may reduce cold offset in a situation where an image-forming apparatus starts image formation immediately after power-on from a power-off state in a low-temperature, low-humidity environment. Although the mechanism is not fully understood, a possible explanation is given below.

As used herein, the term "low-temperature, low-humidity environment" refers to an environment at a temperature of 10° C. or lower and a humidity of 10% RH or lower.

In the first amorphous polyester resin, 5% by mass or less or about 5% by mass or less of the structural units derived from the polyol are structural units derived from a polyol containing a bisphenol-A backbone. In the second amorphous polyester resin, 50% by mass or more or about 50% by mass or more of the structural units derived from the polyol are structural units derived from a polyol containing a bisphenol-A backbone. A bisphenol-A backbone contains a benzene ring, which is highly hydrophobic. The first amorphous polyester resin, in which the percentage of structural units derived from a polyol containing a bisphenol-A backbone is lower than in the second amorphous polyester resin, has relatively high water absorbency. The presence of the first amorphous polyester resin with high water absorbency in the core particles of the toner particles may impart sufficient water retention capacity to the toner particles. Thus, a stable water content may be maintained in the toner according to this exemplary embodiment. In addition, since the polyester resin contains water, the melt viscosity of the toner may decrease easily during fixing. Thus, fixing may be performed at low temperature, and cold offset may be reduced in a situation where it is difficult to supply a sufficient amount of heat to fix a toner image to a recording medium, such as where an image-forming apparatus starts image formation immediately after power-on from a power-off state in a low-temperature, low-humidity environment.

In addition, a polyester resin in which 50% by mass or more of the structural units derived from the polyol are structural units derived from a polyol containing a bisphenol-A backbone (i.e., the second amorphous polyester resin) may have good low-temperature fixability and may also have good offset resistance during the heating of a fixing member of a fixing device. The presence of the second amorphous polyester resin having such properties in the shell layer of the toner according to this exemplary embodiment may reduce cold offset during the heating of a fixing member of a fixing device.

The toner according to this exemplary embodiment will now be described in detail.

The toner according to this exemplary embodiment contains toner particles and optionally an external additive.

Toner Particles

The toner particles contain, for example, binder resins and optionally a colorant, a release agent, and other additives.

Binder Resins

In this exemplary embodiment, the toner particles contain, as binder resins, the first amorphous polyester resin and the second amorphous polyester resin. Optionally, other binder resins may also be used in this exemplary embodiment.

First Amorphous Polyester Resin

The first amorphous polyester resin contains structural units derived from a polycarboxylic acid and structural units derived from a polyol, and 5% by mass or less or about 5% by mass or less of the structural units derived from the polyol are structural units derived from a polyol containing a bisphenol-A backbone. Preferably, 4% by mass or less or about 4% by mass or less, more preferably 2% by mass or less or about 2% by mass or less, even more preferably 1% by mass or less or about 1% by mass or less, of the structural units derived from the polyol in the first amorphous polyester resin are structural units derived from a polyol containing a bisphenol-A backbone. Further preferably, the first amorphous polyester resin contains substantially no structural units derived from a polyol containing a bisphenol-A backbone.

The term "crystalline" in the context of resins refers to the presence of a clear endothermic peak, rather than a stepwise change in the amount of heat absorbed, in differential scanning calorimetry (DSC), specifically, the presence of an endothermic peak having a full width at half maximum of 10° C. or less as measured at a heating rate of 10° C./min.

The term "amorphous" in the context of resins refers to the presence of an endothermic peak having a full width at half maximum of more than 10° C. or a stepwise change in the amount of heat absorbed or the absence of a clear endothermic peak.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, sodium 5-sulfoisophthalate, isophthalic acid, phthalic acid, and naphthalenedicarboxylic acid), and anhydrides and lower alkyl (e.g., having 1 to 5 carbon atoms) esters thereof. Among these polycarboxylic acids, for example, aromatic dicarboxylic acids are preferred.

As polycarboxylic acids, dicarboxylic acids may be used in combination with carboxylic acids with a functionality of 3 or more that form a crosslinked or branched structure. Examples of carboxylic acids with a functionality of 3 or more include trimellitic acid, pyromellitic acid, and anhydrides and lower alkyl (e.g., having 1 to 5 carbon atoms) esters thereof.

These polycarboxylic acids may be used alone or in combination.

Examples of polyols include aliphatic diols (e.g., ethylene glycol, diethylene glycol, triethylene glycol, propylene glycol, butanediol, pentanediol, hexanediol, and neopentyl glycol) and alicyclic diols (e.g., cyclohexanediol, cyclohexanedimethanol, and hydrogenated bisphenol A). Among these polyols, for example, alicyclic diols and aliphatic diols are preferred, and aliphatic diols are more preferred.

As polyols, diols may be used in combination with polyols with a functionality of 3 or more that form a crosslinked or branched structure. Examples of polyols with a functionality of 3 or more include glycerol, trimethylolpropane, and pentaerythritol.

These polyols may be used alone or in combination.

The polycarboxylic acid and the polyol may be used in combination with an epoxy compound. Examples of epoxy compounds include bisphenol A epoxy resins, ethylene glycol diglycidyl ether, glycerol triglycidyl ether, trimethylolpropane triglycidyl ether, trimethylolethane triglycidyl ether, pentaerythritol tetraglycidyl ether, hydroquinone diglycidyl ether, cresol novolac epoxy resins, phenol novolac epoxy resins, polymers and copolymers of vinyl compounds having an epoxy group, epoxylated resorcinol-acetone condensates, and partially epoxylated polybutadiene. In particular, cresol novolac epoxy resins and phenol novolac epoxy resins are preferred for reasons of reactivity.

The epoxy compound is preferably used in the first amorphous polyester resin in an amount of 1 to 20 mole percent, more preferably 2 to 15 mole percent, even more preferably 5 to 12 mole percent, based on the total moles of the polyol.

The first amorphous polyester resin preferably has a glass transition temperature (Tg) of 50° C. to 80° C. or about 50° C. to about 80° C., more preferably 50° C. to 65° C. or about 50° C. to about 65° C.

The glass transition temperature is determined from a DSC curve. Specifically, the glass transition temperature is determined as the extrapolated glass transition initiation temperature defined in the "Determination of Glass Transition Temperature" section of JIS K 7121-1987 "Testing Methods for Transition Temperatures of Plastics".

The first amorphous polyester resin preferably has a weight average molecular weight (Mw) of 5,000 to 1,000,000, more preferably 7,000 to 500,000.

The first amorphous polyester resin preferably has a number average molecular weight (Mn) of 1,000 to 10,000 or about 1,000 to about 10,000, more preferably 2,000 to 9,000 or about 2,000 to about 9,000, even more preferably 3,000 to 8,000 or about 3,000 to about 8,000. The use of a first amorphous polyester resin having a number average molecular weight (Mn) of 1,000 to 10,000 may further reduce cold offset.

The first amorphous polyester resin preferably has a molecular weight distribution Mw/Mn of 1.5 to 100, more preferably 2 to 60.

The weight average molecular weight and the number average molecular weight are measured by gel permeation chromatography (GPC). The molecular weight measurement is performed by GPC on an HLC-8120 GPC system available from Tosoh Corporation using a TSKgel Super HM-M column (15 cm) available from Tosoh Corporation and tetrahydrofuran (THF) solvent. The weight average molecular weight and the number average molecular weight are calculated from the measurements using a molecular weight calibration curve created from monodisperse polystyrene standards.

The first amorphous polyester resin preferably has an ester group concentration M of 0.01 to 0.05 or about 0.01 to about 0.05, more preferably 0.015 to 0.045 or about 0.015 to about 0.045, even more preferably 0.02 to 0.04 or about 0.02 to about 0.04. The use of a first amorphous polyester resin having an ester group concentration M of 0.01 to 0.05 may further reduce cold offset.

The ester group concentration M is represented by equation 1:

$$\text{Ester group concentration } M=K/A \qquad \text{equation 1}$$

where K is the number of ester groups in the first amorphous polyester resin, and A is the number of atoms forming a polymer chain of the first amorphous polyester resin.

The ester group concentration M is a measure of the content of ester groups in the first amorphous polyester resin. The "number of ester groups in the first amorphous polyester resin", as represented by K in equation 1, refers to the number of ester bonds present in the entire first amorphous polyester resin.

The "number of atoms forming a polymer chain of the first amorphous polyester resin", as represented by A in equation 1, refers to the total number of atoms forming the polymer chain of the first amorphous polyester resin, which includes all atoms involved in ester bonds but does not include atoms forming branches at other structural sites. Specifically, the number of atoms counted includes carbon and oxygen atoms derived from carboxy and hydroxy groups involved in ester bonds (two oxygen atoms are present in one ester bond) and other atoms forming the polymer chain, such as six carbon atoms present in an aromatic ring, but does not include hydrogen atoms and substituent atoms and atomic groups on the portions, such as aromatic rings and alkyl groups, forming the polymer chain.

As a specific example, of a total of ten atoms present in an arylene group forming a polymer chain, i.e., six carbon atoms and four hydrogen atoms, only the six carbon atoms are included in the "number of atoms forming a polymer chain of the first amorphous polyester resin". Even if any hydrogen atom is replaced by any substituent, the atoms forming the substituent are not included in the "number of atoms forming a polymer chain of the first amorphous polyester resin".

For example, if the first amorphous polyester resin is a polymer composed of only one type of repeating unit (e.g., if a polymeric compound is represented by the formula $H—[OCOR^1COOR^2O-]_n—H$, where $R^1$ and $R^2$ are divalent groups and n is an integer of 1 or more, the repeating unit is represented by the structure in brackets), two ester bonds are present in the repeating unit (i.e., the number of ester groups in the repeating unit, K', is 2). Hence, the ester group concentration M is calculated by equation 2:

$$\text{Ester group concentration } M=2/A' \qquad \text{equation 2}$$

where A' is the number of atoms forming the polymer chain in the repeating unit.

The ester group concentrations M disclosed herein are calculated by the method described above.

One way to control the ester group concentration M of the first amorphous polyester resin to the above range is to select a polycarboxylic acid and a polyol for polycondensation so that the ester group concentration M falls within the above range.

Second Amorphous Polyester Resin

The second amorphous polyester resin contains structural units derived from a polycarboxylic acid and structural units derived from a polyol, and 50% by mass or more or about 50% by mass or more of the structural units derived from the polyol are structural units derived from a polyol containing a bisphenol-A backbone. Preferably, 60% by mass or more or about 60% by mass or more, more preferably 70% by mass or more or about 70% by mass or more, even more preferably 80% by mass or more or about 80% by mass or more, of the structural units derived from the polyol in the second amorphous polyester resin are structural units derived from a polyol containing a bisphenol-A backbone. Further preferably, substantially all of the structural units derived from the polyol are structural units derived from a polyol containing a bisphenol-A backbone.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides and lower alkyl (e.g., having 1 to 5 carbon atoms) esters thereof. Among these polycarboxylic acids, for example, aromatic dicarboxylic acids are preferred.

As polycarboxylic acids, dicarboxylic acids may be used in combination with carboxylic acids with a functionality of 3 or more that form a crosslinked or branched structure. Examples of carboxylic acids with a functionality of 3 or more include trimellitic acid, pyromellitic acid, and anhydrides and lower alkyl (e.g., having 1 to 5 carbon atoms) esters thereof.

These polycarboxylic acids may be used alone or in combination.

Examples of polyols containing a bisphenol-A backbone include aromatic diol compounds such as alkylene (having 2 or 3 carbon atoms) oxide adducts (an average of 1 to 10 moles added) of bisphenol A such as ethylene oxide adducts of bisphenol A and propylene oxide adducts of bisphenol A.

Examples of polyols containing no bisphenol-A backbone include aliphatic diols (e.g., ethylene glycol, diethylene glycol, triethylene glycol, propylene glycol, butanediol, hexanediol, and neopentyl glycol) and alicyclic diols (e.g., cyclohexanediol, cyclohexanedimethanol, and hydrogenated bisphenol A).

As polyols, diols may be used in combination with polyols with a functionality of 3 or more that form a crosslinked or branched structure. Examples of polyols with a functionality of 3 or more include glycerol, trimethylolpropane, and pentaerythritol.

These polyols may be used alone or in combination.

The second amorphous polyester resin preferably has a glass transition temperature (Tg) of 50° C. to 80° C. or about 50° C. to about 80° C., more preferably 50° C. to 65° C. or about 50° C. to about 65° C.

The second amorphous polyester resin preferably has a weight average molecular weight (Mw) of 5,000 to 1,000,000, more preferably 7,000 to 500,000.

The second amorphous polyester resin may have a number average molecular weight (Mn) of 2,000 to 100,000 or about 2,000 to about 100,000.

The second amorphous polyester resin preferably has a molecular weight distribution Mw/Mn of 1.5 to 100, more preferably 2 to 60.

Manufacture of Polyester Resins

The polyester resins are obtained by a known method of manufacture. Specifically, for example, the polyester resins are obtained by reacting the monomers at a polymerization temperature of 180° C. to 230° C., optionally while removing water and alcohol produced by condensation from the reaction system under reduced pressure.

If the monomers used as starting materials are insoluble in or incompatible with each other at the reaction temperature, the monomers may be dissolved by adding a high-boiling-point solvent as a solubilizer. In this case, a polycondensation reaction is performed while the solubilizer is being distilled off. If there is any poorly compatible monomer in the copolymerization reaction, the poorly compatible monomer may be condensed with any acid or alcohol to be polycondensed with that monomer in advance before they are polycondensed with the major ingredients.

Other Binder Resins

Examples of other binder resins include vinyl resins composed of homopolymers and copolymers of monomers such as styrenes (e.g., styrene, p-chlorostyrene, and a-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Other examples of binder resins include non-vinyl resins such as epoxy resins, polyurethane resins, polyamide resins, cellulose resins, polyether resins, and modified rosins; mixtures of these non-vinyl resins with the vinyl resins; and graft polymers obtained by polymerizing vinyl monomers in the presence of these non-vinyl resins.

The binder resins are preferably present in an amount of, for example, 40% to 95% by mass, more preferably 50% to 90% by mass, even more preferably 60% to 85% by mass, based on the total mass of the toner particles.

In this exemplary embodiment, other binder resins are preferably present in an amount of 0% to 30% by mass, more preferably 0% to 10% by mass, even more preferably 0% to 5% by mass, based on the total mass of the binder resins.

In this exemplary embodiment, the ratio by mass of the first amorphous polyester resin to the second amorphous polyester resin (first amorphous polyester resin/second amorphous polyester resin) is preferably 0.5 to 5.0, more preferably 0.8 to 3.0, even more preferably 1.0 to 2.0.

Colorant

Examples of colorants include various pigments such as carbon black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination.

Optionally, the colorant may be surface-treated or may be used in combination with a dispersant. A combination of colorants may also be used.

The colorant is preferably present in an amount of, for example, 1% to 30% by mass, more preferably 3% to 15% by mass, based on the total mass of the toner particles.

Release Agent

Examples of release agents include, but not limited to, hydrocarbon waxes; natural waxes such as carnauba wax, rice wax, and candelilla wax; synthetic, mineral, and petroleum waxes such as montan wax; and ester waxes such as fatty acid esters and montanic acid esters.

The release agent preferably has a melting temperature of 50° C. to 110° C., more preferably 60° C. to 100° C.

The melting temperature is determined from a DSC curve as the melting peak temperature defined in the "Determination of Melting Temperature" section of JIS K 7121-1987 "Testing Methods for Transition Temperatures of Plastics".

The release agent is preferably present in an amount of, for example, 1% to 10% by mass or about 1% to about 10% by mass, more preferably 2% to 9% by mass or about 2% to about 9% by mass, based on the total mass of the toner particles. If the release agent is present in an amount of 1% to 10% by mass, cold offset may be further reduced.

Other Additives

Examples of other additives include known additives such as magnetic materials, charge control agents, and inorganic powders. These additives are incorporated into the toner particles as internal additives.

Physical Properties of Toner Particles, Etc.

The toner particles according to this exemplary embodiment each include a core particle containing the first amorphous polyester resin and a shell layer disposed on at least a portion of a surface of the core particle and containing the second amorphous polyester resin.

The core particle may contain, for example, the first amorphous polyester resin and optionally a colorant, a release agent, and other additives. The shell layer may contain the second amorphous polyester resin.

The toner particles preferably have a volume average particle size (D50v) of 5 to 14 μm or about 5 to about 14 μm, more preferably 5.5 to 10 μm or about 5.5 to about 10 μm. If the toner particles have a volume average particle size of 5 μm or more, the developer may be less likely to be excessively charged in a low-temperature, low-humidity environment and may thus be less likely to form a toner image with low density. If the toner particles have a volume average particle size of 14 μm or less, the developer may be less likely to be insufficiently charged and may thus be less likely to cause image background fogging.

Various average particle sizes and particle size distribution indices of the toner particles are measured with a Coulter Multisizer II (available from Beckman Coulter, Inc.) using ISOTON-II (available from Beckman Coulter, Inc.) as an electrolyte solution.

Prior to measurement, 0.5 to 50 mg of a test sample is added to 2 mL of a 5% aqueous solution of a surfactant (e.g., sodium alkylbenzenesulfonate), serving as a dispersant, and the mixture is added to 100 to 150 mL of the electrolyte solution.

The sample suspended in the electrolyte solution is dispersed with a sonicator for 1 minute. The particle size distribution of particles having particle sizes in the range of 2 to 60 μm is then measured with a Coulter Multisizer II using an aperture with an aperture diameter of 100 μm. A total of 50,000 particles are sampled.

Based on the measured particle size distribution, cumulative distributions by volume and number are plotted against particle size ranges (channels) from smaller sizes. The volume particle size D16v and the number particle size D16p are defined as the particle size at which the cumulative volume is 16% and the particle size at which the cumulative number is 16%, respectively. The volume average particle size D50v and the number average particle size D50p are defined as the particle size at which the cumulative volume is 50% and the particle size at which the cumulative number is 50%, respectively. The volume particle size D84v and the number particle size D84p are defined as the particle size at which the cumulative volume is 84% and the particle size at which the cumulative number is 84%, respectively.

With these values, the volume particle size distribution index (GSDv) is calculated as $(D84v/D16v)^{1/2}$, and the number particle size distribution index (GSDp) is calculated as $(D84p/D16p)^{1/2}$.

The toner particles preferably have an average circularity of 0.94 to 1.00 or about 0.94 to about 1.00, more preferably 0.95 to 0.98 or about 0.95 to about 0.98.

The average circularity of the toner particles is determined as (equivalent circle perimeter)/(perimeter) (i.e., (perimeter of circle with the same projected area as particle image)/(perimeter of projected particle image)). Specifically, the average circularity is measured by the following method.

The toner particles for measurement are first taken by suction to form a flat flow. Particle images are then captured as still images with instantaneous flashing. The particle images are analyzed with a flow particle image analyzer (FPIA-3000 available from Sysmex Corporation) to determine the average circularity. A total of 3,500 particles are sampled to determine the average circularity.

If the toner contains an external additive, the toner (developer) for measurement is dispersed in water containing a surfactant and is sonicated to obtain toner particles having no external additive.

The second amorphous polyester resin is preferably present in an amount of 50% to 100% by mass or about 50% to about 100% by mass, more preferably 60% to 100% by mass or about 60% to about 100% by mass, even more preferably 70% to 100% by mass or about 70% to about 100% by mass, in regions extending from surfaces of the toner particles to a depth of 1/10 of the volume average particle size of the toner particles. The formation of a shell layer containing the second amorphous polyester resin, which may have good fixability, near the surfaces of the toner particles may reduce cold offset while maintaining sufficient fixability. The percentage of the second amorphous polyester resin is based on the total mass of all binder resins present in the regions extending from the surfaces of the toner particles to a depth of 1/10 of the volume average particle size of the toner particles.

The first amorphous polyester resin is preferably present in an amount of 0% to 50% by mass, more preferably 0% to 40% by mass, even more preferably 0% to 30% by mass, in the regions extending from the surfaces of the toner particles to a depth of 1/10 of the volume average particle size of the toner particles. The percentage of the first amorphous polyester resin is based on the total mass of all binder resins present in the regions extending from the surfaces of the toner particles to a depth of 1/10 of the volume average particle size of the toner particles.

In this exemplary embodiment, for example, if the first and second amorphous polyester resins are used as binder resins, the percentages of the first and second amorphous polyester resins in the regions extending from the surfaces of the toner particles to a depth of 1/10 of the volume average particle size of the toner particles are determined by the following method.

Specifically, the toner is subjected to ultrasonic vibrations with an intensity of 10 W/cm$^2$ at 30° C. for 5 hours and is then centrifuged to separate the external additive from the surfaces of the toner particles. The toner particles are then dried in an environment at 30° C. and 5% RH for 24 hours to obtain toner particles having no external additive. This step may be repeated until the external additive is separated.

The percentage of the second amorphous polyester resin in the regions extending to a depth of 1/10 of the volume average particle size of the toner particles (hereinafter referred to as E1) in this exemplary embodiment is determined by performing surface etching by Ar ion sputtering and then performing intensity comparison with an X-ray photoelectron spectrometer (XPS) (JPS-9000MX available from JEOL Ltd.). The applied voltage for Ar ion sputtering may be set to any value. In this exemplary embodiment, the voltage may be set to 1 kV to allow measurement to a depth of 1/10 of the volume average particle size of the toner particles. The value E1 is calculated based on a signal intensity (Al) unique to an aromatic-free diol component and a signal intensity (Ar) unique to an aromatic-containing diol component. Specifically, the value E1 may be calculated from the measured signal intensities of the toner particles having no external additive by the following equation:

$$E1=Ar/(Ar+Al)\times 100(\%)$$

The percentage of the first amorphous polyester resin in the regions extending to a depth of 1/10 of the volume average particle size of the toner particles (hereinafter referred to as R1) in this exemplary embodiment is determined in the same manner as the percentage of the second amorphous polyester resin. The value R1 is calculated based on a signal intensity (Al) unique to an aromatic-free diol component and a signal intensity (Ar) unique to an aromatic-containing diol component. Specifically, the value R1 may be calculated from the measured signal intensities of the toner particles having no external additive by the following equation:

$$R1=Al/(Ar+Al)\times 100(\%)$$

The first amorphous polyester resin is preferably present in an amount of 50% to 100% by mass, more preferably 65% to 100% by mass, even more preferably 70% to 100% by mass, in regions deeper than a depth of 1/10 of the volume average particle size of the toner particles from the surfaces of the toner particles. The percentage of the first amorphous polyester resin is based on the total mass of all binder resins present in the regions deeper than a depth of 1/10 of the volume average particle size of the toner particles from the surfaces of the toner particles.

The second amorphous polyester resin is preferably present in an amount of 0% to 10% by mass, more preferably 0% to 6% by mass, even more preferably 0% to 2% by mass, in the regions deeper than a depth of 1/10 of the volume average particle size of the toner particles from the surfaces of the toner particles. The percentage of the second amorphous polyester resin is based on the total mass of all binder resins present in the regions deeper than a depth of 1/10 of the volume average particle size of the toner particles from the surfaces of the toner particles.

For example, if the first and second amorphous polyester resins are used as binder resins, the percentages of the first and second amorphous polyester resins in the regions deeper than a depth of 1/10 of the volume average particle size of the toner particles from the surfaces of the toner particles are determined by the following method.

Specifically, toner particles having no external additive are obtained by the same method as described above.

The percentage of the first amorphous polyester resin in the regions deeper than a depth of 1/10 of the volume average particle size of the toner particles (hereinafter referred to as R2) in this exemplary embodiment is determined by performing surface etching by Ar ion sputtering and then performing intensity comparison with an X-ray photoelectron spectrometer (XPS) (JPS-9000MX available from JEOL Ltd.). The applied voltage for Ar ion sputtering may be set to any value. In this exemplary embodiment, the voltage may be set to 5 kV to allow measurement in the region deeper than a depth of 1/10 of the volume average particle size of the toner particles. To determine the percentage of the first amorphous polyester resin at the desired depth, the etch depth may be adjusted by setting an appropriate etching time. The value R2 is calculated based on a signal intensity (Al) unique to an aromatic-free diol component and a signal intensity (Ar) unique to an aromatic-containing diol component. Specifically, the value R2 may be calculated from the measured signal intensities of the toner particles having no external additive by the following equation:

$$R2=\mathrm{Al}/(\mathrm{Ar}+\mathrm{Al})\times 100(\%)$$

The percentage of the second amorphous polyester resin in the regions deeper than a depth of 1/10 of the volume average particle size of the toner particles (hereinafter referred to as E2) in this exemplary embodiment is determined in the same manner as the percentage of the first amorphous polyester resin. The value E2 is calculated based on a signal intensity (Al) unique to an aromatic-free diol component and a signal intensity (Ar) unique to an aromatic-containing diol component. Specifically, the value E2 may be calculated from the measured signal intensities of the toner particles having no external additive by the following equation:

$$E2=\mathrm{Ar}/(\mathrm{Ar}+\mathrm{Al})\times 100(\%)$$

The toner particles preferably have a glass transition temperature of 50° C. to 70° C. or about 50° C. to about 70° C., more preferably 52° C. to 65° C. or about 52° C. to about 65° C., even more preferably 55° C. to 62° C. or about 55° C. to about 62° C. If the toner particles have a glass transition temperature of 50° C. or higher, the toner particles may be less likely to fuse together during storage in a high-temperature, high-humidity environment. If the toner particles have a glass transition temperature of 70° C. or lower, hot offset may be less likely to occur.

The glass transition temperature of the toner particles is measured by the same method as the glass transition temperature of the first amorphous polyester resin. For example, the glass transition temperature is measured with a DSC-20 thermal analyzer (available from Seiko Instruments Inc.) by heating 10 mg of a sample at a constant heating rate (10° C./min).

The toner according to this exemplary embodiment preferably has a melt viscosity A at 110° C. of $1.0\times10^4$ to $8.0\times10^4$ Pa·s or about $1.0\times10^4$ to about $8.0\times10^4$ Pa·s, more preferably $1.5\times10^4$ to $7.5\times10^4$ Pa·s or about $1.5\times10^4$ to about $7.5\times10^4$ Pa·s, even more preferably $2.0\times10^4$ to $7.0\times10^4$ Pas or about $2.0\times10^4$ to about $7.0\times10^4$ Pa·s. If the toner has a melt viscosity A at 110° C. of $1.0\times10^4$ Pa·s or more, blocking may be less likely to occur in a developing device. If the toner has a melt viscosity A at 110° C. of $8.0\times10^4$ Pa·s or less, the effect of reducing cold offset may be more easily achieved.

The melt viscosity of the toner is measured with a CFT-500 Koka-type flow tester (available from Shimadzu Corporation) as the viscosity at the temperature corresponding to half the fall height of a plunger in the range from the flow start point to the flow end point when a 1 $cm^3$ sample is melted and forced to flow through a die orifice with a diameter of 0.5 mm under a load of 0.98 MPa (10 $kg/cm^2$) at a heating rate of 1° C./min.

The toner according to this exemplary embodiment preferably has a ratio (A/B) of the melt viscosity A to a melt viscosity B of 0.01 to 0.5 or about 0.01 to about 0.5, more preferably 0.05 to 0.45 or about 0.05 to about 0.45, even more preferably 0.1 to 0.4 or about 0.1 to about 0.4. The melt viscosity B is measured at 110° C. after drying at 50° C. and 10% RH for 48 hours. If the ratio (A/B) is 0.01 or more, there may be a lower tendency for a decrease in melt viscosity due to moisture absorption in a normal environment. Thus, blocking may be less likely to occur, and therefore, image defects may be less likely to occur. If the ratio (A/B) is 0.5 or less, cold offset may be further reduced.

The ratio (A/B) may be controlled by varying the ester group concentrations of the resins. The ratio (A/B) tends to increase with decreasing ester group concentration and tends to decrease with increasing ester group concentration.

The toner according to this exemplary embodiment preferably has a water content of 2.0% to 5.0% by mass or about 2.0% to about 5.0% by mass, more preferably 2.2% to 4.0% by mass or about 2.2% to about 4.0% by mass, even more preferably 2.4% to 3.0% by mass or about 2.4% to about 3.0% by mass. If the toner has a water content of less than 2.0% by mass, it may be impossible to achieve the advantages of the present invention. If the toner has a water content of more than 5.0% by mass, the problem of image fogging may occur due to variations in the performance of charging devices.

The water content of the toner may be controlled by varying the ester group concentrations of the resins. The water content of the toner tends to increase with increasing ester group concentration and tends to decrease with decreasing ester group concentration.

The water content of the toner may be measured, for example, with a KF-06 volumetric titration moisture meter available from Mitsubishi Kasei Corporation. Specifically, 10 μL of pure water is precisely weighed with a microsyringe, and the amount of water (mg) per milliliter of a Karl Fischer reagent is calculated from the amount of reagent required to titrate the water. Then, 100 to 200 mg of a test sample is precisely weighed and is dispersed with a magnetic stirrer in a test flask for 5 minutes. After dispersion, titration is started, and the total amount of Karl Fischer reagent (mL) required for titration is determined. According to the following equations, the amount of water is calculated, and the water content is calculated from the calculated amount of water:

$$\text{Amount of water (mg)}=\text{amount of reagent consumed (mL)}\times\text{reagent titer(mg } H_2O\text{/mL)}$$

$$\text{Water content (\% by mass)}=(\text{amount of water (mg)}/\text{amount of sample (mg)})\times 100$$

External Additive

Examples of external additives include inorganic particles. Examples of inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $Cao.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles used as the external additive may be hydrophobically treated. For example, the hydrophobic treatment may be performed by immersing the inorganic particles in a hydrophobic agent. Examples of hydrophobic agents include, but not limited to, silane coupling agents, silicone oils, titanate coupling agents, and aluminum coupling agents. These hydrophobic agents may be used alone or in combination.

The hydrophobic agent is typically present in an amount of, for example, 1 to 10 parts by mass based on 100 parts by mass of the inorganic particles.

Other examples of external additives include resin particles (e.g., polystyrene, poly(methyl methacrylate) (PMMA), and melamine resin particles) and cleaning active agents (e.g., metal salts of higher fatty acids, such as zinc stearate, and fluoropolymer particles).

The external additive is preferably added in an amount of, for example, 0.01% to 5% by mass, more preferably 0.01% to 2.0% by mass, based on the total mass of the toner particles.

Method for Manufacturing Toner

A method for manufacturing the toner according to this exemplary embodiment will then be described.

The toner according to this exemplary embodiment is obtained by manufacturing toner particles and then adding an external additive to the toner particles.

The toner particles may be manufactured by either a dry process (e.g., pulverization) or a wet process (e.g., aggregation coalescence, suspension polymerization, or solution suspension). The toner particles may be manufactured by any of these processes, and known processes may be used.

Among these processes, aggregation coalescence may be used to obtain the toner particles.

Specifically, for example, if the toner particles are manufactured by aggregation coalescence, the toner particles are manufactured by the following steps: providing resin particle dispersions such as a first amorphous polyester resin particle dispersion in which first amorphous polyester resin particles are dispersed and a second amorphous polyester resin particle dispersion in which second amorphous polyester resin particles are dispersed (resin-particle-dispersion providing step); aggregating the first amorphous polyester resin particles (and optionally other particles) in the first amorphous polyester resin particle dispersion (optionally mixed with other particle dispersions) to form first aggregated particles serving as core particles (first-aggregated-particle forming step); mixing the dispersion containing the first aggregated particles with the second amorphous polyester resin particle dispersion and aggregating the second amorphous polyester resin particles such that they adhere to the surfaces of the first aggregated particles to form second aggregated particles (second-aggregated-particle forming step); and fusing and coalescing together the second aggregated particles dispersed in the second aggregated particle dispersion by heating the second aggregated particle dispersion to form core-shell toner particles.

The individual steps will now be described in detail.

Although the following description is directed to a method for obtaining toner particles containing a colorant and a release agent, the colorant and the release agent are optional. It should be understood that additives other than colorants and release agents may also be used.

Resin-Particle-Dispersion Providing Step

Resin particle dispersions in which resin particles serving as binder resins are dispersed are first provided. In addition, for example, a colorant particle dispersion in which colorant particles are dispersed and a release agent particle dispersion in which release agent particles are provided.

The resin particle dispersions are prepared, for example, by dispersing resin particles in a dispersion medium with a surfactant.

Examples of dispersion media for use in the resin particle dispersions include aqueous media.

Examples of aqueous media include water, such as distilled water and deionized water, and alcohols. These aqueous media may be used alone or in combination.

Examples of surfactants include anionic surfactants such as sulfuric acid ester salts, sulfonic acid salts, phosphoric acid esters, and soaps; cationic surfactants such as amine salts and quaternary ammonium salts; and nonionic surfactants such as polyethylene glycol, alkylphenol-ethylene oxide adducts, and polyols. Among these surfactants, anionic surfactants and cationic surfactants may be used. Nonionic surfactants may be used in combination with anionic surfactants and cationic surfactants.

These surfactants may be used alone or in combination.

Examples of techniques for dispersing the resin particles in the dispersion medium to prepare the resin particle dispersions include common dispersion techniques such as those using rotary shear homogenizers and media mills such as ball mills, sand mills, and Dyno-Mills. Alternatively, depending on the type of resin particles, the resin particles may be dispersed in the dispersion medium, for example, by phase inversion emulsification.

Phase inversion emulsification is a technique for dispersing a resin in the form of particles in an aqueous medium by dissolving the resin to be dispersed into a hydrophobic organic solvent capable of dissolving the resin, neutralizing the organic continuous phase (O-phase) by adding a base thereto, and introducing an aqueous medium (W-phase) to cause the conversion of the resin from W/O to O/W (phase inversion), thereby forming a discontinuous phase.

The resin particles dispersed in the resin particle dispersions preferably have a volume average particle size of, for example, 0.01 to 1 μm, more preferably 0.08 to 0.8 μm, even more preferably 0.1 to 0.6 μm.

The volume average particle size of the resin particles is measured as follows. A particle size distribution is obtained by measurement with a laser diffraction particle size distribution analyzer (e.g., LA-700 available from Horiba, Ltd.). The particle size distribution is used to plot a cumulative distribution by volume against particle size ranges (channels) from smaller sizes. The volume average particle size D50v is determined as the particle size at which the cumulative volume is 50% of all particles. The volume average particle sizes of the particles in other dispersions are similarly measured.

The resin particles are preferably present in the resin particle dispersions in an amount of, for example, 5% to 50% by mass, more preferably 10% to 40% by mass.

For example, a colorant particle dispersion and a release agent particle dispersion are also prepared in the same manner as the resin particle dispersions. Thus, the colorant particles dispersed in the colorant particle dispersion and the release agent particles dispersed in the release agent particle dispersion are similar in volume average particle size, dispersion medium, dispersion technique, and particle content to the particles in the resin particle dispersions.

First-Aggregated-Particle Forming Step

One resin particle dispersion (first amorphous polyester resin particle dispersion) is then mixed with the colorant particle dispersion and the release agent particle dispersion.

The first amorphous polyester resin particles, the colorant particles, and the release agent particles in the mixed dispersion are subjected to heteroaggregation to form first aggregated particles including the first amorphous polyester resin particles, the colorant particles, and the release agent particles. The first aggregated particles have sizes close to the target size of toner particles.

Specifically, for example, a coagulant is added to the mixed dispersion, and the pH of the mixed dispersion is adjusted to an acidic level (e.g., a pH of 2 to 5). Optionally, a dispersion stabilizer is added. The mixed dispersion is then heated to a temperature in the range from the glass transition temperature of the first amorphous polyester resin minus 30° C. to the glass transition temperature minus 10° C. to allow the particles dispersed in the mixed dispersion to aggregate together and form first aggregated particles.

In the first-aggregated-particle forming step, heating may be performed, for example, after adding a coagulant at room temperature (e.g., 25° C.) while stirring the mixed dispersion with a rotary shear homogenizer, adjusting the pH of the mixed dispersion to an acidic level (e.g., a pH of 2 to 5), and optionally adding a dispersion stabilizer.

Examples of coagulants include surfactants of opposite polarity to the surfactant used as the dispersant added to the mixed dispersion, inorganic metal salts, and divalent and higher-valent metal complexes. In particular, if a metal complex is used as the coagulant, the amount of surfactant used may be reduced, thus improving the charging characteristics.

Additives that form a complex or similar bond with metal ions derived from the coagulant may optionally be used. Examples of such additives include chelating agents.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of chelating agents include oxycarboxylic acids such as tartaric acid, citric acid, and gluconic acid, iminodiacetic acid (IDA), nitrilotriacetic acid (NTA), and ethylenediaminetetraacetic acid (EDTA).

The chelating agent is preferably added in an amount of, for example, 0.01 to 5.0 parts by mass, more preferably 0.1 to less than 3.0 parts by mass, based on 100 parts by mass of the resin particles.

Second-Aggregated-Particle Forming Step

In the second-aggregated-particle forming step, the dispersion containing the first aggregated particles is mixed with the second amorphous polyester resin particle dispersion, and the second amorphous polyester resin particles are aggregated such that they adhere to the surfaces of the first aggregated particles to form second aggregated particles. The second amorphous polyester resin particles deposited on the surfaces of the first aggregated particles form a shell layer.

Specifically, for example, in the second-aggregated-particle forming step, the dispersion containing the first aggregated particles is mixed with the second amorphous polyester resin particle dispersion to obtain a mixed dispersion. A coagulant is added to the mixed dispersion, and the pH of the mixed dispersion is adjusted to an acidic level (e.g., a pH of 2 to 5). Optionally, a dispersion stabilizer is added. The mixed dispersion is then heated to a temperature in the range from the glass transition temperature of the second amorphous polyester resin minus 30° C. to the glass transition temperature minus 10° C. to allow the particles dispersed in the mixed dispersion to aggregate together and form second aggregated particles.

Specific examples of coagulants and other additives for use in the second-aggregated-particle forming step are similar to those for use in the first-aggregated-particle forming step.

Fusion and Coalescence Step

The second aggregated particles dispersed in the second aggregated particle dispersion are then fused and coalesced together by heating the second aggregated particle dispersion, for example, to a temperature of not lower than the glass transition temperature of the resin particles (e.g., a temperature of not lower than 10° C. to 30° C. above the glass transition temperature of the resin particles), thereby forming toner particles.

Toner particles are obtained through these steps.

After the completion of the fusion and coalescence step, the toner particles formed in the solution are subjected to known washing, solid-liquid separation, and drying steps to obtain dry toner particles.

The washing step may be performed by sufficient displacement washing with deionized water for reasons of chargeability. The solid-liquid separation step may be performed by a technique such as, but not limited to, suction filtration or pressure filtration for reasons of productivity. The drying step may be performed by a technique such as, but not limited to, freeze drying, flash drying, fluidized bed drying, or vibratory fluidized bed drying for reasons of productivity.

Humidifying Step

The toner particles obtained as described above may optionally be subjected to humidifying treatment to adjust the water content of the toner to the desired range. Examples of methods for humidification include treatment using commercially available high-temperature, high-humidity environmental test equipment.

The toner according to this exemplary embodiment is manufactured, for example, by adding an external additive to the resulting toner particles and mixing them together. Mixing may be performed, for example, in a V-blender, Henschel mixer, or Lodige mixer. Optionally, coarse toner particles may be removed, for example, with a vibrating sieve or air sieve.

Electrostatic Image Developer

An electrostatic image developer according to this exemplary embodiment contains at least the toner according to this exemplary embodiment.

The electrostatic image developer according to this exemplary embodiment may be a one-component developer containing only the toner according to this exemplary embodiment or a two-component developer containing the toner and a carrier.

The carrier may be any known carrier. Examples of carriers include coated carriers, which are obtained by coating magnetic powders as core materials with coating resins; magnetic powder dispersion carriers, which are obtained by dispersing and mixing magnetic powders in matrix resins; and resin-impregnated carriers, which are obtained by impregnating porous magnetic powders with resins.

The particles that form magnetic powder dispersion carriers and resin-impregnated carriers may be coated as core materials with coating resins.

Examples of magnetic powders include magnetic metals such as iron, nickel, and cobalt and magnetic oxides such as ferrite and magnetite.

Examples of coating resins and matrix resins include polyethylene, polypropylene, polystyrene, polyvinyl acetate, polyvinyl alcohol, polyvinyl butyral, polyvinyl chloride, polyvinyl ethers, polyvinyl ketones, vinyl chloride-vinyl acetate copolymers, styrene-acrylate copolymers, straight silicone resins containing organosiloxane bonds and modified products thereof, fluorocarbon resins, polyesters, polycarbonates, phenolic resins, and epoxy resins.

These coating resins and matrix resins may contain additives such as conductive particles.

Examples of conductive particles include particles of metals such as gold, silver, and copper and other conductive materials such as carbon black, titanium oxide, zinc oxide, tin oxide, barium sulfate, aluminum borate, and potassium titanate.

To coat a core material with a coating resin, for example, the core material may be coated with a solution, for forming a coating layer, prepared by dissolving a coating resin and optionally various additives in a suitable solvent. The solvent may be any solvent selected depending on factors such as the type of coating resin used and suitability for coating.

Specific techniques for coating a core material with a coating resin include dipping, in which a core material is dipped in a solution for forming a coating layer; spraying, in which a core material is sprayed with a solution for forming a coating layer; fluidized bed coating, in which a core material is sprayed with a solution for forming a coating layer while being suspended in an air stream; and kneader coating, in which a carrier core material and a solution for forming a coating layer are mixed together in a kneader coater, followed by removing the solvent.

The mixing ratio (by mass) of the toner to the carrier in the two-component developer is preferably 1:100 to 30:100, more preferably 3:100 to 20:100.

Image-Forming Apparatus and Image-Forming Method

An image-forming apparatus and an image-forming method according to this exemplary embodiment will now be described.

The image-forming apparatus according to this exemplary embodiment includes an image carrier, a charging unit that charges a surface of the image carrier, an electrostatic-image forming unit that forms an electrostatic image on the charged surface of the image carrier, a developing unit that contains an electrostatic image developer and that develops the electrostatic image formed on the surface of the image carrier with the electrostatic image developer to form a toner image, a transfer unit that transfers the toner image from the surface of the image carrier to a surface of a recording medium, and a fixing unit that fixes the toner image to the surface of the recording medium. The electrostatic image developer is the electrostatic image developer according to this exemplary embodiment.

The image-forming apparatus according to this exemplary embodiment executes an image-forming method (the image-forming method according to this exemplary embodiment) including a charging step of charging the surface of the image carrier, an electrostatic-image forming step of forming an electrostatic image on the charged surface of the image carrier, a developing step of developing the electrostatic image formed on the surface of the image carrier with the electrostatic image developer according to this exemplary embodiment to form a toner image, a transfer step of transferring the toner image from the surface of the image carrier to a surface of a recording medium, and a fixing step of fixing the toner image to the surface of the recording medium.

The image-forming apparatus according to this exemplary embodiment may be a known type of image-forming apparatus such as a direct-transfer apparatus, which transfers a toner image from a surface of an image carrier directly to a recording medium; an intermediate-transfer apparatus, which transfers a toner image from a surface of an image carrier to a surface of an intermediate transfer member and then transfers the toner image from the surface of the intermediate transfer member to a surface of a recording medium; an apparatus including a cleaning unit that cleans a surface of an image carrier after the transfer of a toner image and before charging; or an apparatus including an erase unit that removes any charge from a surface of an image carrier by irradiation with erase light after the transfer of a toner image and before charging.

For an intermediate-transfer apparatus, the transfer unit includes, for example, an intermediate transfer member having a surface to which a toner image is transferred, a first transfer unit that transfers a toner image from the surface of the image carrier to the surface of the intermediate transfer member, and a second transfer unit that transfers the toner image from the surface of the intermediate transfer member to a surface of a recording medium.

In the image-forming apparatus according to this exemplary embodiment, for example, the section including the developing unit may form a cartridge structure (process cartridge) attachable to and detachable from the image-forming apparatus. The process cartridge may include, for example, a developing unit containing the electrostatic image developer according to this exemplary embodiment.

A non-limiting example of the image-forming apparatus according to this exemplary embodiment will now be described. The following description will focus on the relevant parts shown in the drawings, and a description of other parts is omitted herein.

FIG. 1 is a schematic view of the image-forming apparatus according to this exemplary embodiment.

The image-forming apparatus shown in FIG. 1 includes first to fourth electrophotographic image-forming units 10Y, 10M, 10C, and 10K that produce yellow (Y), magenta (M), cyan (C), and black (K) images, respectively, based on image data generated by color separation. These image-forming units (which may be hereinafter simply referred to as "units") 10Y, 10M, 10C, and 10K are arranged side-by-side at a predetermined distance from each other in the horizontal direction. These units 10Y, 10M, 10C, and 10K may form process cartridges attachable to and detachable from the image-forming apparatus.

An intermediate transfer belt 20, serving as an intermediate transfer member, extends above and through the units 10Y, 10M, 10C, and 10K in the figure. The intermediate transfer belt 20 is entrained about a drive roller 22 and a support roller 24 so that the intermediate transfer belt 20 runs in the direction from the first unit 10Y toward the fourth unit 10K. The drive roller 22 is disposed at a distance from the support roller 24 in the direction from left to right in the figure. The support roller 24 is disposed in contact with the inner surface of the intermediate transfer belt 20. The support roller 24 is urged away from the drive roller 22 by a member such as a spring (not shown) to apply tension to the intermediate transfer belt 20 entrained about the two rollers 22 and 24. An intermediate-transfer-belt cleaning device 30 is disposed on the image carrier side of the intermediate transfer belt 20 and opposite the drive roller 22.

The developing devices (developing units) 4Y, 4M, 4C, and 4K of the units 10Y, 10M, 10C, and 10K are supplied with toners, including yellow, magenta, cyan, and black toners, from toner cartridges 8Y, 8M, 8C, and 8K, respectively.

Since the first to fourth units 10Y, 10M, 10C, and 10K have the same configuration, the first unit 10Y, which is a yellow-image forming unit disposed upstream in the running direction of the intermediate transfer belt 20, will be described as a representative example. The same parts as in the first unit 10Y are labeled with the same reference numerals followed by the letters M (magenta), C (cyan), and K (black), rather than the letter Y (yellow), and a description of the second to fourth units 10M, 10C, and 10K is omitted herein.

The first unit 10Y includes a photoreceptor 1Y serving as an image carrier. Around the photoreceptor 1Y are disposed, in sequence, a charging roller (an example of a charging unit) 2Y that charges the surface of the photoreceptor 1Y to a predetermined potential, an exposure device (an example of an electrostatic-image forming unit) 3 that exposes the charged surface of the photoreceptor 1Y to a laser beam 3Y based on image signals generated by color separation to form an electrostatic image, a developing device (an example of a developing unit) 4Y that supplies a charged toner to the electrostatic image to develop the electrostatic image, a first transfer roller (an example of a first transfer unit) 5Y that transfers the developed toner image to the intermediate transfer belt 20, and a photoreceptor cleaning device (an example of a cleaning unit) 6Y that removes any residual toner from the surface of the photoreceptor 1Y after the first transfer.

The first transfer roller 5Y is disposed inside the intermediate transfer belt 20 and opposite the photoreceptor 1Y. The first transfer rollers 5Y, 5M, 5C, and 5K are each connected to a bias supply (not shown) that applies a first transfer bias. Each bias supply is controlled by a controller (not shown) to change the transfer bias applied to the corresponding first transfer roller.

The yellow-image forming operation of the first unit 10Y will now be described.

Prior to the operation, the surface of the photoreceptor 1Y is charged to a potential of −600 to −800 V by the charging roller 2Y.

The photoreceptor 1Y includes a photosensitive layer formed on a conductive (e.g., having a volume resistivity of $1\times10^{-6}$ Ωcm or less at 20° C.) substrate. The photosensitive layer, which normally has high resistivity (the resistivity of common resins), has the property of, upon exposure to the laser beam 3Y, changing its resistivity in the area exposed to the laser beam 3Y. Accordingly, the laser beam 3Y is directed onto the charged surface of the photoreceptor 1Y via the exposure device 3 based on yellow image data fed from a controller (not shown). The photosensitive layer forming the surface of the photoreceptor 1Y is exposed to the laser beam 3Y, thereby forming an electrostatic image of the yellow image pattern on the surface of the photoreceptor 1Y.

The term "electrostatic image" refers to an image formed on the surface of the photoreceptor 1Y by electric charge, i.e., a negative latent image formed after electric charge dissipates from the surface of the photoreceptor 1Y in the area exposed to the laser beam 3Y, where the resistivity of the photosensitive layer has decreased, while remaining in the area not exposed to the laser beam 3Y.

As the photoreceptor 1Y rotates, the electrostatic image formed on the photoreceptor 1Y is transported to a predetermined developing position. At the developing position, the electrostatic image on the photoreceptor 1Y is made visible (developed) to form a toner image by the developing device 4Y.

The developing device 4Y contains, for example, an electrostatic image developer containing at least a yellow toner and a carrier. The yellow toner is triboelectrically charged while being stirred in the developing device 4Y. The yellow toner, which has been charged to the same polarity (negative) as the surface of the photoreceptor 1Y, is carried on a developer roller (an example of a developer carrier). As the surface of the photoreceptor 1Y passes through the developing device 4Y, the yellow toner is electrostatically attracted to and develops the latent image formed on the surface of the photoreceptor 1Y. As the photoreceptor 1Y having the yellow toner image formed thereon continues to rotate at a predetermined speed, the toner image formed on the photoreceptor 1Y is transported to a predetermined first transfer position.

When the yellow toner image on the photoreceptor 1Y is transported to the first transfer position, a first transfer bias is applied to the first transfer roller 5Y. The first transfer bias exerts an electrostatic force acting from the photoreceptor 1Y toward the first transfer roller 5Y on the toner image to transfer the toner image from the photoreceptor 1Y to the intermediate transfer belt 20. The transfer bias applied is opposite in polarity (positive) to the toner (negative). For example, the transfer bias for the first unit 10Y is controlled to +10 μA by a controller (not shown).

Any residual toner is removed and collected from the photoreceptor 1Y by the photoreceptor cleaning device 6Y.

The first transfer biases applied to the first transfer rollers 5M, 5C, and 5K of the second, third, and fourth units 10M, 10C, and 10K are controlled in the same manner as the first transfer bias applied to the first transfer roller 5Y of the first unit 10Y.

In this way, the intermediate transfer belt 20 to which the yellow toner image has been transferred in the first unit 10Y is sequentially transported through the second, third, and fourth units 10M, 10C, and 10K to transfer toner images of the corresponding colors to the intermediate transfer belt 20 such that the toner images are superimposed on top of each other.

The toner images of the four colors transferred to the intermediate transfer belt 20 through the first to fourth units 10Y, 10M, 10C, and 10K are transported to a second transfer section including the intermediate transfer belt 20, the support roller 24 in contact with the inner surface of the intermediate transfer belt 20, and a second transfer roller (an example of a second transfer unit) 26 disposed on the image carrier side of the intermediate transfer belt 20. A sheet of recording paper (an example of a recording medium) P is fed into the nip between the second transfer roller 26 and the intermediate transfer belt 20 at a predetermined timing by a feed mechanism, and a second transfer bias is applied to the support roller 24. The transfer bias applied is identical in polarity (negative) to the toner (negative). The second transfer bias exerts an electrostatic force acting from the intermediate transfer belt 20 toward the recording paper P on the toner image to transfer the toner image from the intermediate transfer belt 20 to the recording paper P. The second transfer bias is determined depending on the resistance detected by a resistance detector (not shown) that detects the resistance of the second transfer section, and the voltage is controlled accordingly.

The recording paper P is then transported into the nip between a pair of fixing rollers in a fixing device (an example of a fixing unit) 28. The toner image is fixed to the recording paper P to form a fixed image.

Examples of the recording paper P to which the toner image is transferred include plain paper used for systems such as electrophotographic copiers and printers. Examples of recording media other than the recording paper P include OHP sheets.

The recording paper P may have a smooth surface so that the fixed image has improved surface smoothness. For example, coated paper, which is plain paper coated with a resin or other material, and art paper for printing may be used.

The recording paper P having the fixed color image is transported to an output section, and the color-image forming operation ends.

Process Cartridge and Toner Cartridge

A process cartridge according to this exemplary embodiment will now be described.

The process cartridge according to this exemplary embodiment is attachable to and detachable from an image-forming apparatus. The process cartridge according to this exemplary embodiment includes a developing unit that contains the electrostatic image developer according to this exemplary embodiment and that develops an electrostatic image formed on a surface of an image carrier with the electrostatic image developer to form a toner image.

The process cartridge according to this exemplary embodiment need not have the configuration described above, but may have a configuration including a developing unit and optionally at least one other unit selected from, for example, an image carrier, a charging unit, an electrostatic-image forming unit, and a transfer unit.

A non-limiting example of the process cartridge according to this exemplary embodiment will now be described. The following description will focus on the relevant parts shown in the drawings, and a description of other parts is omitted herein.

Figure 2:
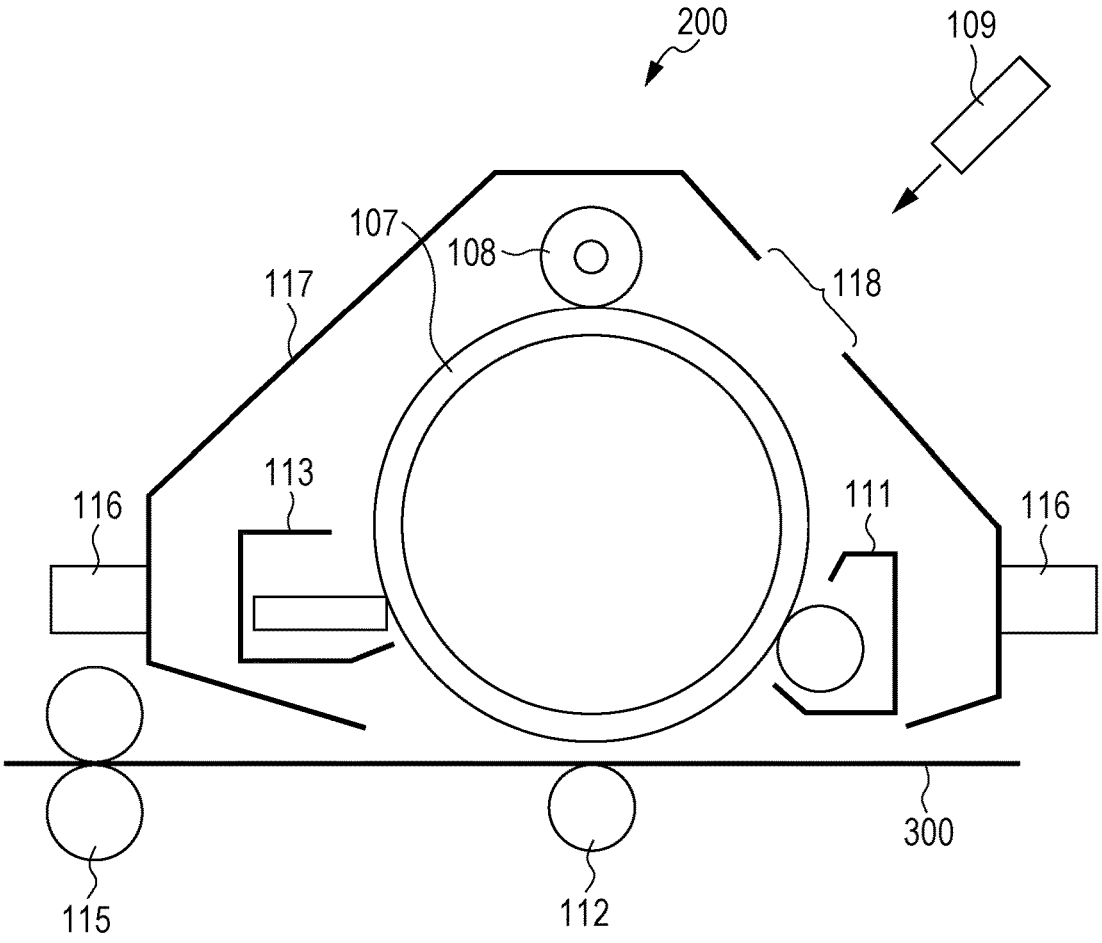
FIG. 2 is a schematic view of an example process cartridge according to this exemplary embodiment.

FIG. 2 is a schematic view of the process cartridge according to this exemplary embodiment.

A process cartridge 200 shown in FIG. 2 includes, for example, a housing 117 having mounting rails 116 and an opening 118 for exposure. The housing 117 holds together a photoreceptor 107 (an example of an image carrier) and a charging roller 108 (an example of a charging unit), a developing device 111 (an example of a developing unit), and a photoreceptor cleaning device 113 (an example of a cleaning unit) that are disposed around the photoreceptor 107, thereby forming a cartridge.

FIG. 2 also illustrates an exposure device 109 (an example of an electrostatic-image forming unit), a transfer device 112 (an example of a transfer unit), a fixing device 115 (an example of a fixing unit), and recording paper 300 (an example of a recording medium).

A toner cartridge according to this exemplary embodiment will now be described.

The toner cartridge according to this exemplary embodiment is attachable to and detachable from an image-forming apparatus and contains the toner according to this exemplary embodiment. The toner cartridge contains refill toner to be supplied to a developing unit disposed in an image-forming apparatus.

The image-forming apparatus shown in FIG. 1 is configured such that the toner cartridges 8Y, 8M, 8C, and 8K are attachable to and detachable from the image-forming apparatus. The developing devices 4Y, 4M, 4C, and 4K are connected to the toner cartridges corresponding to the respective developing devices (colors) through toner supply tubes (not shown). The toner cartridges are replaced when the toner level is low.

EXAMPLES

This exemplary embodiment will now be more specifically described with reference to the following examples and comparative examples, although these examples are not intended to limit this exemplary embodiment. Parts and percentages are by mass unless otherwise specified.

Preparation of First Amorphous Polyester Resin (A1)

Polycarboxylic Acids

Terephthalic acid: 90 molar parts

Sodium 5-sulfoisophthalate: 10 molar parts

Polyols

Ethylene glycol: 45 molar parts 1,5-Pentanediol: 46 molar parts

Epoxy Compound

Polyepoxy compound (EPICLON N-695 available from DIC corporation): 9 molar parts In a 5 L flask equipped with a stirrer, a nitrogen inlet tube, a temperature sensor, and a fractionating column are placed a total of 3 parts of the above polycarboxylic acid components, polyol components, and epoxy compound. The temperature is increased to 190° C. over 1 hour. After it is confirmed that the interior of the reaction system is being stirred, the catalyst $Ti(OBu)_4$ (titanium tetrabutoxide, 0.003% based on the total mass of the polycarboxylic acid components) is added.

While the resulting water is being distilled off, the temperature is gradually increased to 245° C., and the dehydration condensation reaction is continued to perform a polymerization reaction for 6 hours. The temperature is then decreased to 235° C., and the reaction is continued under a reduced pressure of 30 mmHg for 2 hours to obtain First Amorphous Polyester Resin (A1). In First Amorphous Polyester Resin (A1), 0% of the structural units derived from the polyols are structural units derived from polyols containing a bisphenol-A backbone.

First Amorphous Polyester Resin (A1) has an ester group concentration of 0.04 and a number average molecular weight of 3,000.

Preparation of First Amorphous Polyester Resin Particle Dispersion (A1)

While a 3 L jacketed reaction vessel (BJ-30N available from Tokyo Rikakikai Co., Ltd.) equipped with a condenser, a thermometer, a water dropping unit, and an anchor blade is maintained at 40° C. in a water-circulating thermostatic bath, a solvent mixture of 160 parts of ethyl acetate and 100 parts of isopropyl alcohol is placed into the reaction vessel. To the solvent mixture is added 300 parts of First Amorphous Polyester Resin (A1). The resin is dissolved with stirring at 150 rpm using a Three-One Motor to obtain an oil phase. With the oil phase being stirred, 14 parts of 10% aqueous ammonia solution is added dropwise over 5 minutes, followed by mixing for 10 minutes. Furthermore, 900 parts of deionized water is added dropwise at a rate of 7 parts per minute to induce phase conversion. An emulsion is obtained.

Into a 2 L recovery flask are immediately placed 800 parts of the resulting emulsion and 700 parts of deionized water. The recovery flask is set on an evaporator (available from Tokyo Rikakikai Co., Ltd.) equipped with a vacuum control unit with a bump trap therebetween. The recovery flask is warmed in a warm bath at 60° C. while being rotated, and the pressure is reduced to 7 kPa to remove the solvent, with care being taken to avoid bumping. After a total of 1,100 parts of solvent is recovered, the pressure is returned to atmospheric pressure, and the recovery flask is water-cooled to obtain a dispersion. The resulting dispersion has no solvent odor. The resin particles in the dispersion have a volume average particle size D50 of 130 nm.

The solid content of the dispersion is then adjusted to 20% by adding deionized water to obtain First Amorphous Polyester Resin Particle Dispersion (A1).

Preparation of First Amorphous Polyester Resin (A2)

Polycarboxylic Acids

Terephthalic acid: 98 molar parts

Sodium 5-sulfoisophthalate: 2 molar parts

Polyols

Ethylene glycol: 50 molar parts 1,5-Pentanediol: 50 molar parts

First Amorphous Polyester Resin (A2) is prepared in the same manner as First Amorphous Polyester Resin (A1) except that the above polycarboxylic acid components and polyol components are used. In First Amorphous Polyester Resin (A2), 0% of the structural units derived from the polyols are structural units derived from polyols containing a bisphenol-A backbone.

First Amorphous Polyester Resin (A2) has an ester group concentration of 0.03 and a number average molecular weight of 4,500.

Preparation of First Amorphous Polyester Resin Particle Dispersion (A2)

First Amorphous Polyester Resin Particle Dispersion (A2) is prepared in the same manner as First Amorphous Polyester Resin Particle Dispersion (A1) except that First Amorphous Polyester Resin (A1) is replaced with First Amorphous Polyester Resin (A2).

Preparation of Second Amorphous Polyester Resin (B1)

Adduct of bisphenol A with 2.2 mol of ethylene oxide: 40 molar parts

Adduct of bisphenol A with 2.2 mol of propylene oxide: 60 molar parts

Terephthalic acid: 47 molar parts

Fumaric acid: 40 molar parts

Dodecenylsuccinic anhydride: 15 molar parts

Trimellitic anhydride: 3 molar parts

Into a reaction vessel equipped with a stirrer, a thermometer, a condenser, and a nitrogen gas inlet tube are placed the above monomers other than fumaric acid and trimellitic anhydride and tin dioctanoate in an amount of 0.25 part based on a total of 100 parts of the above monomers. After the mixture is reacted at 235° C. in a nitrogen gas stream for 6 hours, the temperature is decreased to 200° C., and fumaric acid and trimellitic anhydride are added and reacted for 1 hour. The temperature is increased to 220° C. over 4 hours, and the monomers are polymerized to the desired molecular weight under a pressure of 10 kPa to obtain Second Amorphous Polyester Resin (B1), which is pale yellow and transparent. In Second Amorphous Polyester Resin (B1), 100% of the structural units derived from the polyols are structural units derived from polyols containing a bisphenol-A backbone.

Preparation of Second Amorphous Polyester Resin Particle Dispersion (B1)

Second Amorphous Polyester Resin Particle Dispersion (B1) is prepared in the same manner as First Amorphous Polyester Resin Particle Dispersion (A1) except that First Amorphous Polyester Resin (A1) is replaced with Second Amorphous Polyester Resin (B1).

Preparation of Release Agent Particle Dispersion

Polyethylene wax (PW725 available from Toyo ADL Corporation, melting temperature=100° C.): 50 parts Anionic surfactant (Neogen RK available from DKS Co. Ltd.): 0.5 part Deionized water: 200 parts The above ingredients are mixed together, and the mixture is heated to 95° C. and is dispersed with a homogenizer (ULTRA-TURRAX T50 available from IKA). The mixture is then dispersed with a Manton-Gaulin high-pressure homogenizer (available from Gaulin) to obtain a release agent particle dispersion (with a solid content of 20%) in which a release agent is dispersed. The release agent has a volume average particle size of 0.23 μm.

Preparation of Colorant Particle Dispersion

Cyan pigment (Pigment Blue 15:3 (copper phthalocyanine) available from Dainichiseika Color & Chemicals Mfg. Co., Ltd.): 1,000 parts Anionic surfactant (Neogen R available from DKS Co. Ltd.): 15 parts Deionized water: 9,000 parts The above ingredients are mixed together, and the mixture is dispersed with a high-pressure impact disperser (Ultimaizer HJP-30006 available from Sugino Machine Limited) for 1 hour to obtain a colorant particle dispersion in which a colorant (cyan pigment) is dispersed. The colorant (cyan pigment) in the colorant particle dispersion has a volume average particle size of 0.16 μm. The colorant particle dispersion has a solid content of 20%.

Example 1

Preparation of Toner Particles (1)

Into a reaction vessel equipped with a stirrer and a mantle heater are placed 100 parts of First Amorphous Polyester Resin Particle Dispersion (A1), 5 parts of the release agent particle dispersion, 8 parts of the colorant particle dispersion, and a solution of 4.0 parts of an anionic surfactant (Dowfax available from the Dow Chemical Company) in 800 parts of deionized water. The slurry is stirred at 40° C. for 1 hour while the rotational speed of the stirrer is adjusted so that the slurry is sufficiently stirred. After the slurry is adjusted to a pH of 3.0 by adding 1.0% nitric acid, it is confirmed that the resin particles are dispersed, and 10 parts of Second Amorphous Polyester Resin Particle Dispersion (B1) is added over 5 minutes. After the mixture is maintained at 40° C. for 30 minutes, the mixture is adjusted to a pH of 9.0 by adding 1% aqueous sodium hydroxide solution. The mixture is then heated to 90° C. at a heating rate of 1° C./min while being adjusted to a pH of 9.0 every 5° C. and is maintained at 90° C. The particle shape and the surface properties are observed under a light microscope and a field-emission scanning electron microscope (FE-SEM). After 10 hours, the coalescence of the particles is observed, and the vessel is cooled to 30° C. with cooling water over 5 minutes.

The cooled slurry is passed through a 15 μm nylon mesh to remove coarse particles, and the toner slurry that has passed through the mesh is filtered under reduced pressure with an aspirator. The solid residue on the filter is crushed as finely as possible by hand, and the solids are added to an amount of deionized water that is 10 times the amount of the solids at 30° C. and are mixed with stirring for 30 minutes. The mixture is then filtered under reduced pressure with an aspirator. The solid residue on the filter is crushed as finely as possible by hand, and the solids are added to an amount of deionized water that is 10 times the amount of the solids at 30° C. and are mixed with stirring for 30 minutes. The mixture is then filtered again under reduced pressure with an aspirator, and the electrical conductivity of the filtrate is measured. This procedure is repeated until the electrical conductivity of the filtrate decreases to 10 μS/cm or less, followed by washing the solids.

The washed solids are finely crushed with a wet/dry granulator (Comil) and are vacuum-dried in an oven at 35° C. for 36 hours. The solids are then stored in an environment (50° C. and 10% RH) at an absolute humidity of 53 g/m$^3$ for 48 hours to obtain Toner Particles (1). Toner Particles (1) have a volume average particle size of 7.0 μm.

Preparation of Toner

Toner (1) is prepared by mixing together 100 parts of Toner Particles (1) and 0.7 part of dimethyl-silicone-oil-treated silica particles (RY200 available from Nippon Aerosil Co., Ltd.) in a Henschel mixer.

Preparation of Carrier (1)

Into a Henschel mixer is placed 500 parts of a powder of spherical magnetite particles having a volume average particle size of 0.22 μm. After stirring, 4.5 parts of a titanate coupling agent is added, and the mixture is heated to 95° C. and is mixed with stirring for 30 minutes to obtain spherical magnetite particles coated with a titanate coupling agent.

Next, 6.5 parts of phenol, 10 parts of 30% formalin, 500 parts of the magnetite particles, 7 parts of 25% aqueous ammonia solution, and 400 parts of water are placed into a 1 L four-necked flask and are mixed with stirring. The mixture is then heated to 85° C. with stirring over 60 minutes and is reacted at the same temperature for 180 minutes, followed by cooling to 25° C. After 500 parts of water is added, the supernatant is removed, and the sediment is washed with water. The sediment is dried at 180° C. under reduced pressure and is passed through a 106 μm mesh sieve to remove coarse particles. Core Particles A having an average particle size of 32 μm are obtained.

A coating resin solution is then prepared by stirring 200 parts of toluene and 45 parts of a styrene-methacrylate copolymer (compositional molar ratio=20:80, weight average molecular weight=180,000) with a stirrer for 60 minutes.

Into a vacuum-degassing kneader coater (with a rotor-to-wall clearance of 25 mm) are placed 1,000 parts of Core Particles A and 40 parts of the coating resin solution. The mixture is maintained at 60° C. and is stirred at 40 rpm for 30 minutes. The temperature is then increased to 85° C., and the pressure is reduced to perform the removal of toluene, degassing, and drying. The mixture is then passed through a 75 μm mesh to obtain Carrier (1). Carrier (1) has a shape factor SF2 of 106.

The shape factor SF2 is determined by observing the carrier under a light microscope at a magnification of 400 times and inputting image information for 100 randomly selected carrier particles to an image analyzer (LUZEX FT available from Nireco Corporation) for analysis. The shape factor SF2 is represented by the following equation:

$$SF2=(1/4\pi)\times(I^2/A)\times 100$$

where I is the perimeter of a carrier particle in an image, and A is the projected area of the carrier particle. The average shape factor SF2 of the 100 carrier particles is employed.

Preparation of Developer (1)

Developer (1) is prepared by stirring 8 parts of Toner (1) and 100 parts of Carrier (1) in a V-blender at 20 rpm for 20 minutes and passing the mixture through a 212 μm mesh sieve.

Example 2

Toner Particles (2) are prepared as in Example 1 except that the amount of adduct of bisphenol A with 2.2 mol of propylene oxide is changed to 65 molar parts in the preparation of Second Amorphous Polyester Resin (B1). These toner particles are used to prepare Developer (2) as in Example 1.

Example 3

Toner Particles (3) are prepared as in Example 1 except that the amount of adduct of bisphenol A with 2.2 mol of propylene oxide is changed to 51 molar parts in the preparation of Second Amorphous Polyester Resin (B1). These toner particles are used to prepare Developer (3) as in Example 1.

Example 4

Toner Particles (4) are prepared as in Example 1 except that, in the preparation of First Amorphous Polyester Resin (A1), the amount of terephthalic acid is changed to 87 molar parts, the amount of sodium 5-sulfoisophthalate is changed to 12 molar parts, the amount of ethylene glycol is changed to 50 molar parts, and the amount of 1,5-pentanediol is changed to 40 molar parts. These toner particles are used to prepare Developer (4) as in Example 1.

Example 5

Toner Particles (5) are prepared as in Example 1 except that, in the preparation of First Amorphous Polyester Resin (A1), the amount of terephthalic acid is changed to 96 molar parts, the amount of sodium 5-sulfoisophthalate is changed to 5 molar parts, the amount of ethylene glycol is changed to 50 molar parts, and the amount of 1,5-pentanediol is changed to 50 molar parts. These toner particles are used to prepare Developer (5) as in Example 1.

Example 6

Toner Particles (6) are prepared as in Example 1 except that, in the preparation of First Amorphous Polyester Resin (A1), the amount of terephthalic acid is changed to 96 molar parts, and the amount of polyepoxy compound is changed to 12 molar parts. Toner Particles (6) are used to prepare Developer (6) as in Example 1.

Example 7

Toner Particles (7) are prepared as in Example 1 except that, in the preparation of First Amorphous Polyester Resin (A1), the amount of terephthalic acid is changed to 86 molar parts, and the amount of polyepoxy compound is changed to 7 molar parts. Toner Particles (7) are used to prepare Developer (7) as in Example 1.

Example 8

Toner Particles (8) are prepared as in Example 1 except that stirring at 40° C. for 1 hour is replaced with stirring at 50° C. for 2 hours in the preparation of Toner Particles (1). Toner Particles (8) are used to prepare Developer (8) as in Example 1.

Example 9

Toner Particles (9) are prepared as in Example 1 except that stirring at 40° C. for 1 hour is replaced with stirring at 40° C. for 30 minutes in the preparation of Toner Particles (1). Toner Particles (9) are used to prepare Developer (9) as in Example 1.

Example 10

Toner Particles (10) are prepared as in Example 1 except that the amount of Second Amorphous Polyester Resin Particle Dispersion (B1) is changed to 5 parts. Toner Particles (10) are used to prepare Developer (10) as in Example 1.

Example 11

Toner Particles (11) are prepared as in Example 1 except that the amount of release agent particle dispersion is changed to 9 parts. Toner Particles (11) are used to prepare Developer (11) as in Example 1.

Example 12

Toner Particles (12) are prepared as in Example 1 except that the amount of release agent particle dispersion is changed to 1 part. Toner Particles (12) are used to prepare Developer (12) as in Example 1.

Example 13

Toner Particles (13) are prepared as in Example 1 except that, in the preparation of First Amorphous Polyester Resin (A1), the amount of terephthalic acid is changed to 95 molar parts, the amount of sodium 5-sulfoisophthalate is changed to 14 molar parts, the amount of ethylene glycol is changed to 50 molar parts, and the amount of 1,5-pentanediol is changed to 40 molar parts. Toner Particles (13) are used to prepare Developer (13) as in Example 1.

Example 14

Toner Particles (14) are prepared as in Example 1 except that, in the preparation of First Amorphous Polyester Resin (A1), the amount of terephthalic acid is changed to 92 molar parts, the amount of sodium 5-sulfoisophthalate is changed to 3 molar parts, the amount of ethylene glycol is changed to 60 molar parts, and the amount of 1,5-pentanediol is changed to 50 molar parts. Toner Particles (14) are used to prepare Developer (14) as in Example 1.

Example 15

Toner Particles (15) are prepared as in Example 1 except that First Amorphous Polyester Resin Particle Dispersion (A1) is replaced with First Amorphous Polyester Resin Particle Dispersion (A2) in the preparation of the toner particles. Toner Particles (15) are used to prepare Developer (15) as in Example 1.

Example 16

Toner Particles (16) are prepared as in Example 1 except that the amount of polyepoxy compound is changed to 20 molar parts. Toner Particles (16) are used to prepare Developer (16) as in Example 1.

Example 17

Toner Particles (17) are prepared as in Example 1 except that the amount of polyepoxy compound is changed to 0.5 molar part. Toner Particles (17) are used to prepare Developer (17) as in Example 1.

Comparative Example 1

Toner Particles (18) are prepared as in Example 1 except that, in the preparation of First Amorphous Polyester Resin (A1), the amount of terephthalic acid is changed to 82 molar parts, the amount of sodium 5-sulfoisophthalate is changed to 8 molar parts, the amount of ethylene glycol is changed to 40 molar parts, the amount of 1,5-pentanediol is changed to 40 molar parts, and the amount of polyepoxy compound is changed to 4 molar parts. Toner Particles (18) are used to prepare Developer (18) as in Example 1.

Comparative Example 2

Toner Particles (19) are prepared as in Example 1 except that, in the preparation of First Amorphous Polyester Resin (A1), the amount of terephthalic acid is changed to 100 molar parts, the amount of sodium 5-sulfoisophthalate is changed to 20 molar parts, the amount of ethylene glycol is changed to 55 molar parts, the amount of 1,5-pentanediol is changed to 50 molar parts, and the amount of polyepoxy compound is changed to 8 molar parts. Toner Particles (19) are used to prepare Developer (19) as in Example 1.

Evaluation for Image Density and Background Image Fogging (Fogging)

A modified DocuCentre Color 500 (available from Fuji Xerox Co., Ltd., fixing temperature=220° C., image-forming speed=250 mm/sec), which is an image-forming apparatus that employs two-component contact development, is provided. Each developer is charged into a developing device of the image-forming apparatus and is allowed to stand in an environment at 50° C. and 100% RH for 2 hours. An image with an area coverage (AC) of 15% (a chart image having a pattern including 3 cm square black solid images in the upper left, center, and lower right with respect to the sheet transport direction) is then printed on 500 sheets of paper (Premier 80 available from Xerox Corporation, A4 size). The image on the 500th sheet is evaluated for fogging and density as follows.

The density is measured in the center of each of the three black solid images, i.e., at a total of three points, with an image densitometer (X-Rite 938 available from X-Rite, Incorporated), and the average density E is calculated. The results are rated on the following rating scale:

Rating Scale for Image Density

A (Excellent): E is 1.4 or more

B (Good): E is 1.2 to less than 1.4

C (Fair): E is 1.0 to less than 1.2

D (Poor): E is less than 1.0

A to C are acceptable for practical use.

After the printing of the black solid images, blank printing is performed. The density is measured at one point in the center of the sheet, two points 50 mm from the top and 50 mm from the left and right, and two points 50 mm from the bottom and 50 mm from the left and right, i.e., at a total of five points, with an image densitometer (X-Rite 938 available from X-Rite, Incorporated), and the difference in density between the printed and unprinted sheets, ΔE, is calculated. The results are rated on the following rating scale:

Rating Scale for Background Image Fogging (Fogging)

A (Excellent): ΔE is less than 0.3

B (Good): ΔE is 0.3 to less than 0.5

C (Fair): ΔE is 0.5 to less than 1.0

D (Poor): ΔE is 1.0 or more

A to C are acceptable for practical use.

Evaluation for Cold Offset

A modified DocuCentre Color 500 (available from Fuji Xerox Co., Ltd., fixing temperature=120° C., image-forming speed=350 mm/sec), which is an image-forming apparatus that employs two-component contact development, is provided. Each developer is charged into a developing device of the image-forming apparatus and is allowed to stand in an environment at 10° C. and 10% RH for 48 hours, with the image-forming apparatus being in a power-off state. Immediately after power-on, an image with an image density of 100% and a width of 20 mm is printed in the sheet transport direction on 20 sheets of recording paper (Colotech+90 gsm available from Xerox Corporation). The image on the 20th sheet is rated on the following rating scale:

A (Excellent): completely no problem

B (Good): no image defects are observed by visual inspection, but slight image defects are observed when magnified C (Fair): a level at which minor, acceptable image defects are observed D (Poor): determined to be unacceptable (unsuitable for practical use) due to image defects Evaluation for Hot Offset A modified DocuCentre Color 500 (available from Fuji Xerox Co., Ltd., fixing temperature=220° C., image-forming speed=250 mm/sec), which is an image-forming apparatus that employs two-component contact development, is provided. Each developer is charged into a developing device of the image-forming apparatus and is allowed to stand at 30° C. and 100% RH for 48 hours. An image with an image density of 100% and a width of 20 mm is then printed in the sheet transport direction on 20 sheets of recording paper (Colotech+90 gsm available from Xerox Corporation). The image on the 20th sheet is rated on the following rating scale:

A (Excellent): completely no problem

B (Good): no image defects are observed by visual inspection, but slight image defects are observed when magnified C (Fair): a level at which minor, acceptable image defects are observed D (Poor): determined to be unacceptable due to image defects Evaluation for White Streaks A modified DocuCentre Color 500 (available from Fuji Xerox Co., Ltd., fixing temperature=220° C., image-forming speed=250 mm/sec), which is an image-forming apparatus that employs two-component contact development, is provided. A test is performed in which an image pattern including 3 cm square black solid images in the upper left, center, and lower right with respect to the sheet transport direction is continuously printed on 10,000 sheets of C2 paper available from Fuji Xerox Co., Ltd. The solid images on the 1,000th sheet and the developing blade after printing on 10,000 sheets are observed and rated on the following rating scale:

G1 (Excellent): there are no white streaks in the black solid images, and no toner is deposited on the developing blade (layer-thickness regulating member)

G2 (Good): some toner is deposited on the developing blade, but there are no white streaks in the black solid images G3 (Fair): some toner is deposited on the developing blade, but there are only slight white streaks in the black solid images G4 (Poor): there are white streaks over the entire black solid images G1 to G3 are acceptable for practical use.

The physical properties of the toners and the toner particles are shown in Table 1. The evaluation results are shown in Table 2.

In Table 1, the term "percentage of first amorphous PES (shell)" refers to the percentage of the first amorphous polyester resin in regions extending from the surfaces of the toner particles to a depth of 1/10 of the volume average particle size of the toner particles.

In Table 1, the term "percentage of second amorphous PES (shell)" refers to the percentage of the second amorphous polyester resin in the regions extending from the surfaces of the toner particles to a depth of 1/10 of the volume average particle size of the toner particles.

In Table 1, the term "percentage of first amorphous PES (core)" refers to the percentage of the first amorphous polyester resin in regions deeper than a depth of 1/10 of the volume average particle size of the toner particles from the surfaces of the toner particles.

In Table 1, the term "percentage of second amorphous PES (core)" refers to the percentage of the second amorphous polyester resin in the regions deeper than a depth of 1/10 of the volume average particle size of the toner particles from the surfaces of the toner particles.

TABLE 1

| | Melt viscosity | | | | | Toner particles | | | | | |
|---|---|---|---|---|---|---|---|---|---|---|---|
| | Melt viscosity A ($\times 10^4$ Pa · s) | Melt viscosity B ($\times 10^4$ Pa · s) | A/B | Water content (%) | Tg (° C.) | Volume average particle size (μm) | Percentage of first amorphous PES (core) (%) | Percentage of second amorphous PES (core) (%) | Percentage of first amorphous PES (shell) (%) | Percentage of second amorphous PES (shell) (%) | Release agent content (%) |
| Example 1 | 2.0 | 9.0 | 0.222 | 3.4 | 58 | 7.0 | 98.6 | 1.4 | 20 | 80 | 5.0 |
| Example 2 | 7.6 | 17.6 | 0.432 | 2.8 | 59 | 7.1 | 98.2 | 1.8 | 19 | 81 | 5.0 |
| Example 3 | 1.2 | 6.2 | 0.194 | 2.5 | 58 | 7.0 | 97.9 | 2.1 | 18 | 82 | 5.0 |
| Example 4 | 3.8 | 8.0 | 0.475 | 2.7 | 57 | 7.0 | 98.4 | 1.6 | 21 | 79 | 5.0 |
| Example 5 | 1.8 | 97.3 | 0.018 | 2.9 | 58 | 7.1 | 98.3 | 1.7 | 20 | 80 | 5.0 |
| Example 6 | 2.0 | 7.8 | 0.256 | 2.4 | 68 | 6.9 | 98.5 | 1.5 | 19 | 81 | 5.0 |
| Example 7 | 2.1 | 11.2 | 0.188 | 2.6 | 51 | 7.1 | 98.2 | 1.8 | 18 | 82 | 5.0 |
| Example 8 | 2.0 | 9.1 | 0.220 | 2.7 | 58 | 13.0 | 97.9 | 2.1 | 21 | 79 | 5.0 |
| Example 9 | 2.3 | 8.4 | 0.274 | 3.1 | 58 | 5.2 | 98.1 | 1.9 | 22 | 78 | 5.0 |
| Example 10 | 2.1 | 7.9 | 0.266 | 3.5 | 57 | 7.1 | 98.5 | 1.5 | 47 | 53 | 5.0 |

TABLE 1-continued

| | Melt viscosity | | | | | Toner particles | | | | | |
|---|---|---|---|---|---|---|---|---|---|---|---|
| | Melt viscosity A ($\times 10^4$ Pa · s) | Melt viscosity B ($\times 10^4$ Pa · s) | A/B | Water content (%) | Tg (° C.) | Volume average particle size (μm) | Percentage of first amorphous PES (core) (%) | Percentage of second amorphous PES (core) (%) | Percentage of first amorphous PES (shell) (%) | Percentage of second amorphous PES (shell) (%) | Release agent content (%) |
| Example 11 | 1.8 | 8.6 | 0.209 | 3.4 | 59 | 7.0 | 98.6 | 1.4 | 19 | 81 | 9.0 |
| Example 12 | 1.9 | 8.4 | 0.226 | 2.9 | 58 | 7.1 | 99.1 | 0.9 | 20 | 80 | 1.1 |
| Example 13 | 3.9 | 7.4 | 0.527 | 2.8 | 58 | 7.0 | 97.9 | 2.1 | 19 | 81 | 5.0 |
| Example 14 | 1.3 | 146.8 | 0.009 | 3.1 | 59 | 7.0 | 98.0 | 2.0 | 21 | 79 | 5.0 |
| Example 15 | 1.5 | 7.9 | 0.190 | 3.1 | 59 | 7.0 | 98.7 | 1.3 | 47 | 53 | 5.0 |
| Example 16 | 1.9 | 8.4 | 0.226 | 3.2 | 73 | 7.0 | 99.0 | 1.0 | 21 | 79 | 5.0 |
| Example 17 | 3.5 | 7.5 | 0.467 | 2.4 | 48 | 7.0 | 98.7 | 1.3 | 19 | 81 | 5.0 |
| Comparative Example 1 | 1.2 | 13.0 | 0.092 | 1.6 | 52 | 7.1 | 98.6 | 1.4 | 21 | 79 | 5.0 |
| Comparative Example 2 | 7.8 | 8.1 | 0.963 | 6.1 | 52 | 7.1 | 98.4 | 1.6 | 46 | 54 | 5.0 |

TABLE 2

| | Evaluation | | | | |
|---|---|---|---|---|---|
| | Cold offset resistance | Hot offset resistance | Low image density | Image fogging | White streaks |
| Example 1 | A | A | A | A | G1 |
| Example 2 | B | A | A | A | G1 |
| Example 3 | A | B | A | A | G1 |
| Example 4 | B | A | A | A | G1 |
| Example 5 | A | A | A | A | G2 |
| Example 6 | B | A | A | A | G1 |
| Example 7 | A | B | A | A | G1 |
| Example 8 | A | A | A | C | G2 |
| Example 9 | A | A | C | A | G1 |
| Example 10 | C | A | A | A | G1 |
| Example 11 | A | C | A | A | G3 |
| Example 12 | C | A | A | C | G1 |
| Example 13 | C | A | A | A | G1 |
| Example 14 | A | A | A | A | G3 |
| Example 15 | A | A | A | A | G1 |
| Example 16 | C | A | A | A | G1 |
| Example 17 | A | C | A | A | G1 |
| Comparative Example 1 | D | D | B | D | G4 |
| Comparative Example 2 | D | D | B | D | G4 |

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising toner particles, each comprising:

a core particle comprising a first amorphous polyester resin comprising structural units derived from a polycarboxylic acid and structural units derived from a polyol, wherein about 5% by mass or less of the structural units derived from the polyol are structural units derived from a polyol containing a bisphenol-A backbone; and a shell layer disposed on at least a portion of a surface of the core particle, the shell layer comprising a second amorphous polyester resin comprising structural units derived from a polycarboxylic acid and structural units derived from a polyol, wherein about 50% by mass or more of the structural units derived from the polyol are structural units derived from a polyol containing a bisphenol-A backbone, the electrostatic-image developing toner having a water content of about 2.0% to about 5.0% by mass; wherein the electrostatic-image developing toner has a melt viscosity A at 110° C. of about $1.0\times10^4$ to about $8.0\times10^4$ Pa·s.

2. The electrostatic-image developing toner according to claim 1, wherein the electrostatic-image developing toner has a water content of about 2.4% to about 3.0% by mass.

3. The electrostatic-image developing toner according to claim 1, wherein an ingredient composition for the first amorphous polyester resin includes an epoxy compound.

4. The electrostatic-image developing toner according to claim 1, wherein an ingredient composition for the first amorphous polyester resin includes 1,5-pentanediol.

5. The electrostatic-image developing toner according to claim 1, wherein an ingredient composition for the first amorphous polyester resin includes dodecenylsuccinic acid.

6. The electrostatic-image developing toner according to claim 1, wherein the second amorphous polyester resin is present in an amount of about 50% to about 100% by mass in regions extending from surfaces of the toner particles to a depth of 1/10 of the volume average particle size of the toner particles.

7. The electrostatic-image developing toner according to claim 1, wherein the toner particles have a glass transition temperature (Tg) of about 50° C. to about 70° C.

8. The electrostatic-image developing toner according to claim 1, wherein the toner particles have an average circularity of about 0.94 to about 1.00.

9. The electrostatic-image developing toner according to claim 1, wherein the first amorphous polyester resin has a glass transition temperature (Tg) of about 50° C. to about 80° C.

10. The electrostatic-image developing toner according to claim 1, wherein the second amorphous polyester resin has a glass transition temperature (Tg) of about 50° C. to about 80° C.

11. The electrostatic-image developing toner according to claim 1, wherein the first amorphous polyester resin has an ester group concentration M of about 0.01 to about 0.05, wherein the ester group concentration M is represented by equation 1:

$$\text{Ester group concentration } M = K/A \qquad \text{equation 1}$$

wherein K is the number of ester groups in the first amorphous polyester resin, and A is the number of atoms forming a polymer chain of the first amorphous polyester resin.

12. The electrostatic-image developing toner according to claim 1, wherein the first amorphous polyester resin has a number average molecular weight of about 1,000 to about 10,000.

13. The electrostatic-image developing toner according to claim 1, wherein the second amorphous polyester resin has a number average molecular weight of about 2,000 to about 100,000.

14. The electrostatic-image developing toner according to claim 1, wherein the electrostatic-image developing toner has a ratio (A/B) of the melt viscosity A to a melt viscosity B of about 0.01 to about 0.5, wherein the melt viscosity B is measured at 110° C. after drying at 50° C. and 10% RH for 48 hours.

15. The electrostatic-image developing toner according to claim 1, wherein the toner particles have a volume average particle size of about 5 to about 14 μm.

16. The electrostatic-image developing toner according to claim 1, wherein the toner particles contain a release agent in an amount of about 1% to about 10% by mass.

17. An electrostatic image developer comprising the electrostatic-image developing toner according to claim 1.

18. A toner cartridge attachable to and detachable from an image-forming apparatus, the toner cartridge containing the electrostatic-image developing toner according to claim 1.

* * * * *